US005832821A

United States Patent [19]

Petersen et al.

[11] Patent Number: 5,832,821

[45] Date of Patent: Nov. 10, 1998

[54] DRIVEN CYLINDER

[75] Inventors: Godber Petersen, Augsburg; Josef Göttling; Bernhard Feller, both of Friedberg; Hans Fleischmann, Augsburg, all of Germany

[73] Assignee: MAN Roland Druckmaschinen AG, Offenbach am Main, Germany

[21] Appl. No.: 879,143

[22] Filed: Jun. 19, 1997

[30] Foreign Application Priority Data

Jun. 19, 1996 [DE] Germany ..... 196 24 394.7

[51] Int. Cl.[6] ..... B41F 5/00; B41F 13/10

[52] U.S. Cl. ..... 101/216; 101/375; 310/67 R

[58] Field of Search ..... 101/216, 219, 101/365, 375; 310/67 R

[56] References Cited

U.S. PATENT DOCUMENTS

| | | | |
|---|---|---|---|
| 4,820,947 | 4/1989 | Beisiegel et al. . | |
| 5,429,051 | 7/1995 | Laubscher | 101/219 |
| 5,711,221 | 1/1998 | Compera et al. | 101/375 |

FOREIGN PATENT DOCUMENTS

| | | |
|---|---|---|
| 0 689 277 | 12/1985 | European Pat. Off. . |
| 195 15 459 | 10/1996 | Germany . |

*Primary Examiner*—Eugene H. Eickholt

*Attorney, Agent, or Firm*—Cohen, Pontani, Lieberman & Pavane

[57] ABSTRACT

In a compact drive for a float-mounted cylinder of a rotary printing machine, the spindle carrying the cylinder is housed together with a motor in a carrier tube mounted in the side wall.

9 Claims, 5 Drawing Sheets

DRIVEN CYLINDER

BACKGROUND OF THE INVENTION

1. Field of the Invention

The invention relates to a driven cylinder of an aggregate of a rotary printing machine.

2. Description of the Prior Art

German application DE 195 15 459.2 discusses a rubber blanket cylinder that is float-mounted in the side wall of a printing unit. The rubber blanket cylinder is attached to a spindle, which is mounted in a housing, which in turn is held in two walls. The spindle is driven by a drive to which it is connected or by toothed gears. Drives of this type are large and technically complicated. In some cases, oil lubrication is needed. Because of the elasticity of the drive, rotary play occurs at the driven cylinder. In toothed-gear drives, the torsion becomes even greater due to the backlash.

SUMMARY OF THE INVENTION

Accordingly, it is an object of the present invention to provide a play-free, compact drive for cylinders.

Pursuant to this object, and others which will become apparent hereafter, one aspect of the present invention resides in a driven cylinder of an aggregate of a rotary printing machine having a side wall in which the cylinder is float mounted, which driven cylinder is comprised of a spindle, a cylinder body arranged on the spindle, a rotatable carrier tube mounted in the side wall, the spindle being mounted in the carrier tube, and motor means for driving the cylinder body. The motor means being arranged in the carrier tube and connected to the spindle.

The direct attachment of the motor to the spindle carrying the cylinder guarantees a stable and play-free drive. Spindle units of this type are compact and have few individual parts, and thus can be economically built. Furthermore, no external lubrication is necessary. This cylinder type is advantageous, for example, in so-called single wall machines for small press runs. Form cylinders of this type are well-suited for the production of printing forms in the printing machine using what is known as "computer-to-press technology. " Furthermore, the individual drive of cylinders of this type makes it possible to carry out set-up procedures simultaneously. For example, while a printing form is being produced on a form cylinder, an adjacent transfer cylinder can be separately driven for a washing procedure.

In another embodiment of the invention the cylinder is pot-shaped and has a bottom with an outer surface to which a head of the spindle is attached.

In another embodiment of the invention the cylinder body is configured to have a bottom approximately at a midpoint along a longitudinal axis of the cylinder. The spindle head being connected to the bottom of the cylinder body.

In still another embodiment of the invention, the carrier tube is rotatably mounted in the side wall and the spindle is mounted in the side wall eccentrically relative to the rotational axis of the carrier tube. Furthermore, adjustment means are provided for rotating the carrier tube.

Yet another embodiment of the invention provides the carrier tube to be mounted in the side wall in an axially movable manner. Adjustment means are provided for actually moving the carrier tube.

The driven cylinder can be configured as either a form cylinder, a transfer cylinder, a web transport roller or a folding unit cylinder.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
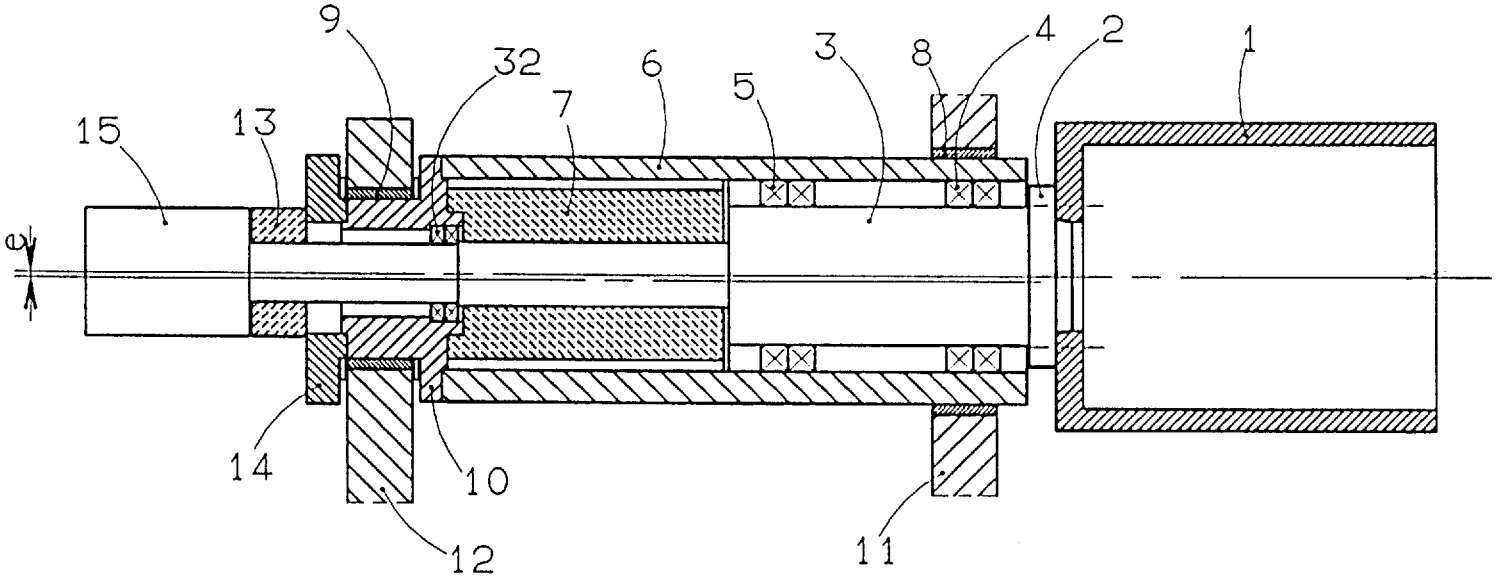
FIG. 1 is a longitudinal section of a cylinder, including spindle unit, pursuant to the present invention.

FIG. 1 shows the float mounting of a cylinder 1, which can be, for example, the form cylinder or transfer cylinder of a printing group. The cylinder 1 is pot-shaped, and its bottom is attached to the spindle head 2 of a spindle 3. Advantageously, this attachment is carried out using screws, and the cylinder 1 is held without play by means of a ball socket. The spindle 3 is mounted in a carrier tube with high axial and radial rigidity by roller bearings 4, 5. A motor 7 (advantageously, a so-called "kit" motor), that is also supported in the carrier tube 6, is located on an extended journal of the spindle 3, which is also supported by a bearing 32. This arrangement ensures a rigid, play-free connection of the motor 7 to the cylinder 1. The carrier tube 6 is mounted in slide bearings 8, 9 in a side wall 11 and in a support wall 12. In the illustrated embodiment, the carrier tube 6 is sealed by a sleeve 10, which is held in the slide bearing 9. The bearing, which is located in the supporting wall 12, provides the carrier tube 6 with especially stable support. The bearing can be designed, for example, as a plate screwed onto the side wall 11 with spacing supports or as a bridge screwed onto the side wall 11. The carrier tube 6 can be rotated in the slide bearings 8, 9, which makes it possible for the positioning movements of the cylinder 1 described below to be carried out. To this end, the spindle 3, along with the cylinder 1, is eccentric to the rotational axis of the carrier tube 6. In the illustrated embodiment, the bore in the carrier tube 6 in which the spindle 3 is mounted is eccentric to the outer tube diameter, which carries the bearing seat for accommodation in the slide bearing 8. Similarly, the seat for the bearing 32 in the sleeve 10 is eccentric to the bearing seat for the slide bearing 9.

A rotary encoder 13 required for the purpose of drive control is attached to the spindle 3 and supported by a lever 14, which in turn is attached to the sleeve 10. The spindle 3 is sealed by a two-way feed 15, via which a liquid medium for printing process controls, e.g., a cooling device, can be fed into and out of the cylinder 1.

Figure 2:
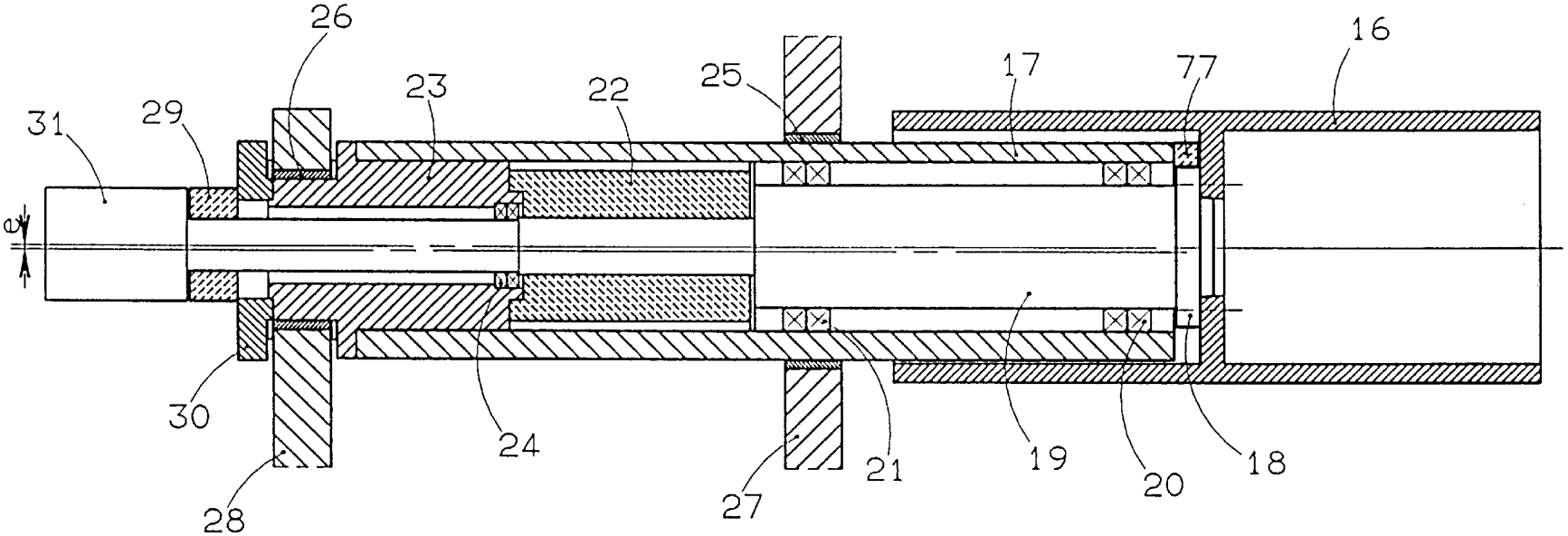
FIG. 2 is a view similar to FIG. 1, of a further embodiment.

FIG. 2 shows a cylinder 16 with a spindle unit that is wider in design and can therefore work with webs of greater width. The cylinder 16, for example, a transfer cylinder, is double pot-shaped, i.e., it has a bottom located approximately at its middle. The cylinder 16 is attached by this bottom to the spindle head 18 of a spindle 19. The spindle 19 is mounted by means of roller bearings 20, 21 in a carrier tube 17, which also holds the kit motor 22 that is attached to the spindle 19. The kit motor 22 is supported in the carrier tube 17 by means of a sleeve 23. The extended journal of the spindle 19 also runs in a roller bearing 24. The carrier tube 17 is mounted by means of slide bearings 25, 26 in a side wall 27 and a support wall 28. The extended journal extends out of the side wall 27 to approximately the middle of the cylinder 16. As a result, the spindle 19 is held in a highly stable fashion in this area. Furthermore, the central arrangement of the bottom, by which the cylinder 16 is attached to the spindle head 18, is advantageous for low-bend operation of the cylinder 16. Its load is thus distributed evenly on both two sides of the bottom.

As FIG. 2 also shows, a rotary encoder 29 attached to the spindle 19 is supported on a lever 30, which in turn is attached to the sleeve 23. Again, there is a two-way feed 31, via which the media for printing process control can be fed into and out of the cylinder 16. The cylinder 16 is eccentric relative to the pivot axis of the carrier tube 17.

FIG. 2 also shows an alternative way to arrange a rotary encoder. A so-called spur gear rotary encoder 77 is located in the vicinity of the spindle head 18 at the end of the carrier tube 17. The toothing for the rotary encoder 77 is worked into the external diameter of the spindle head 18.

The float mounting is also suitable for other driven cylinders of printing machines. For example, a web transport roller or the cylinder of a folding unit can be attached to the spindle head 2, 18.

In these cases, the eccentricity "e" can be omitted. It is also possible to manufacture the cylinder and the spindle from a single piece, for example, in the case of a folding unit cylinder.

Figure 3:
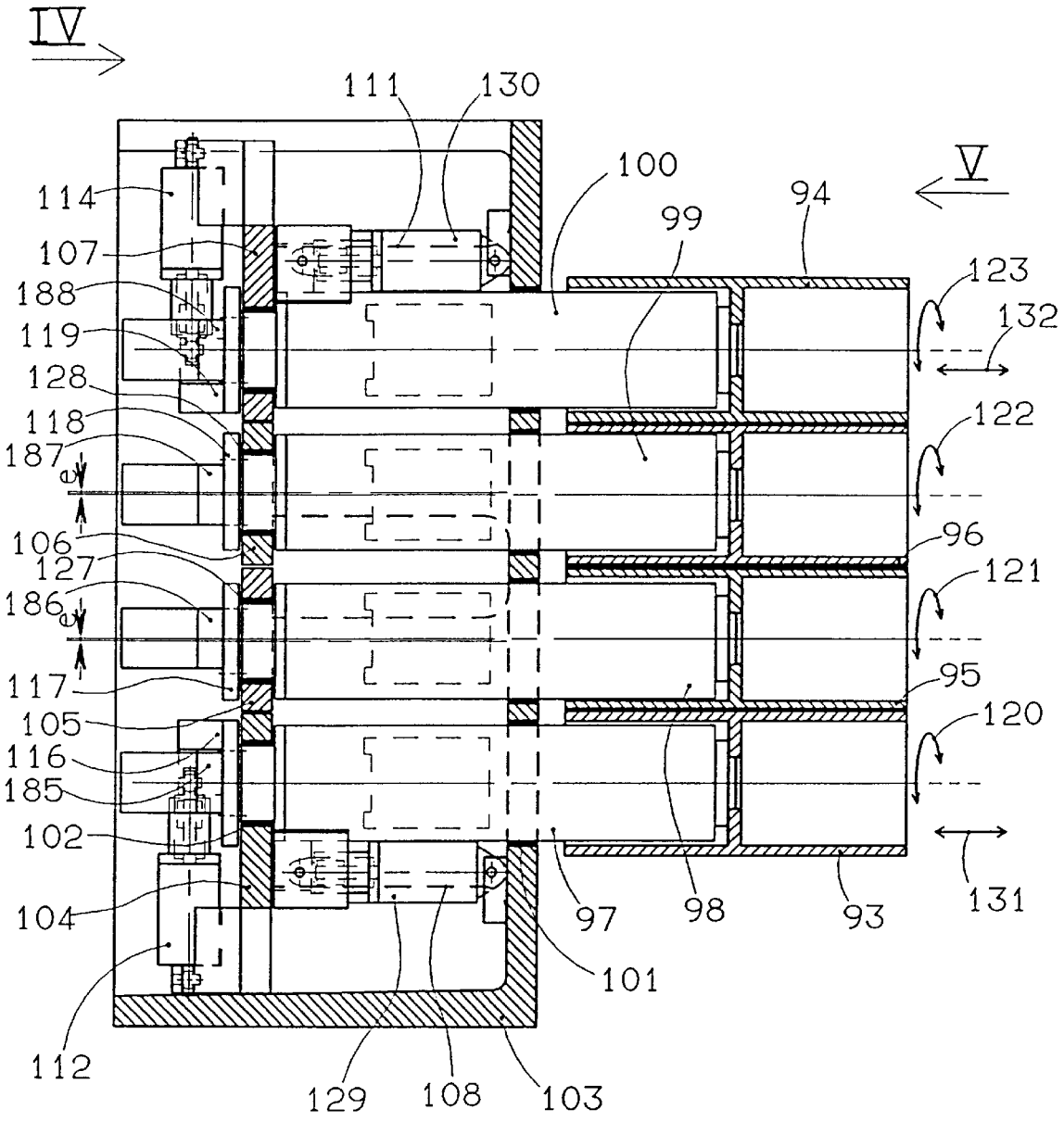
FIG. 3 is a section of an offset printing group with float-mounted cylinders, along the line III—III in FIG. 4.
Figure 4:
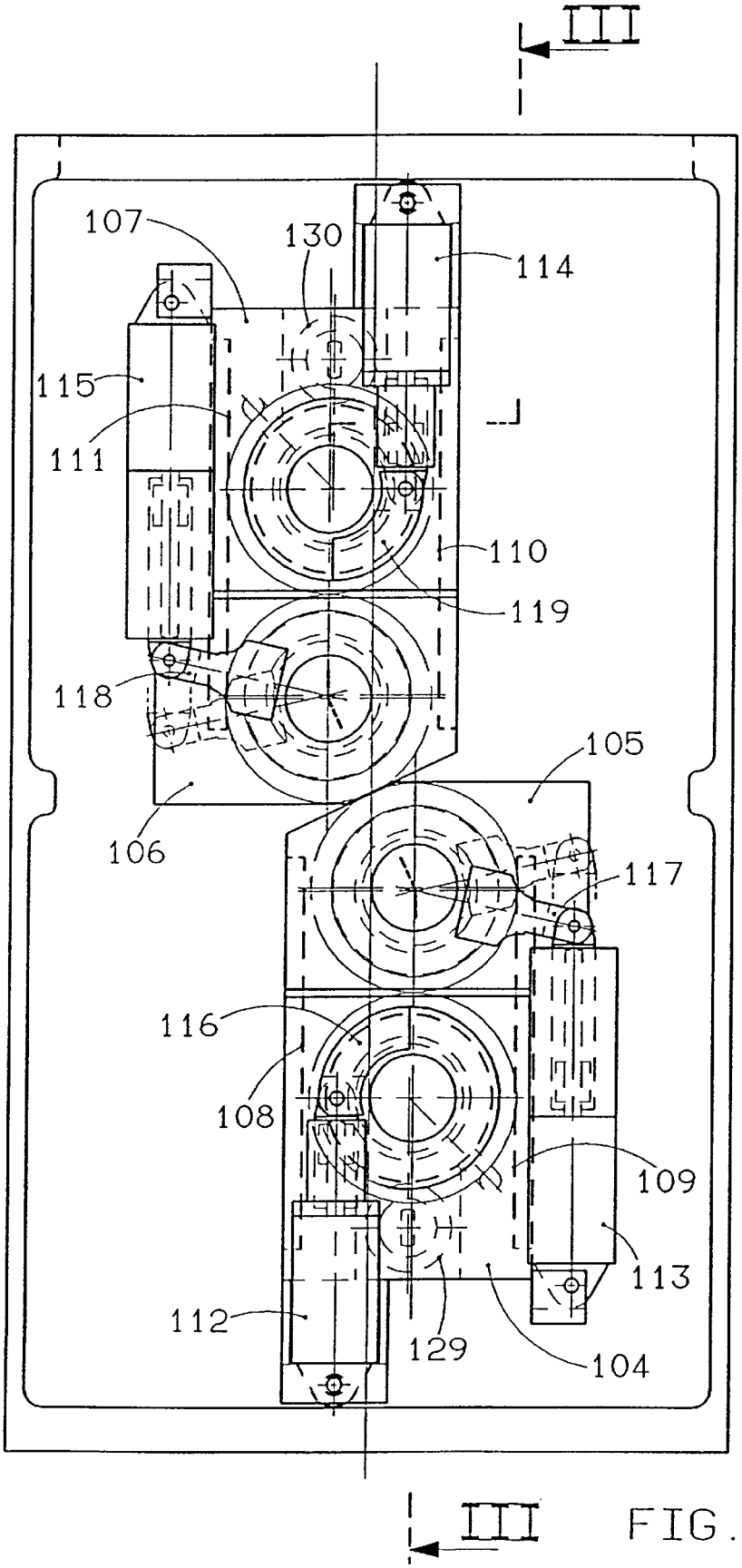
FIG. 4 is a view IV in FIG. 3.
Figure 5:
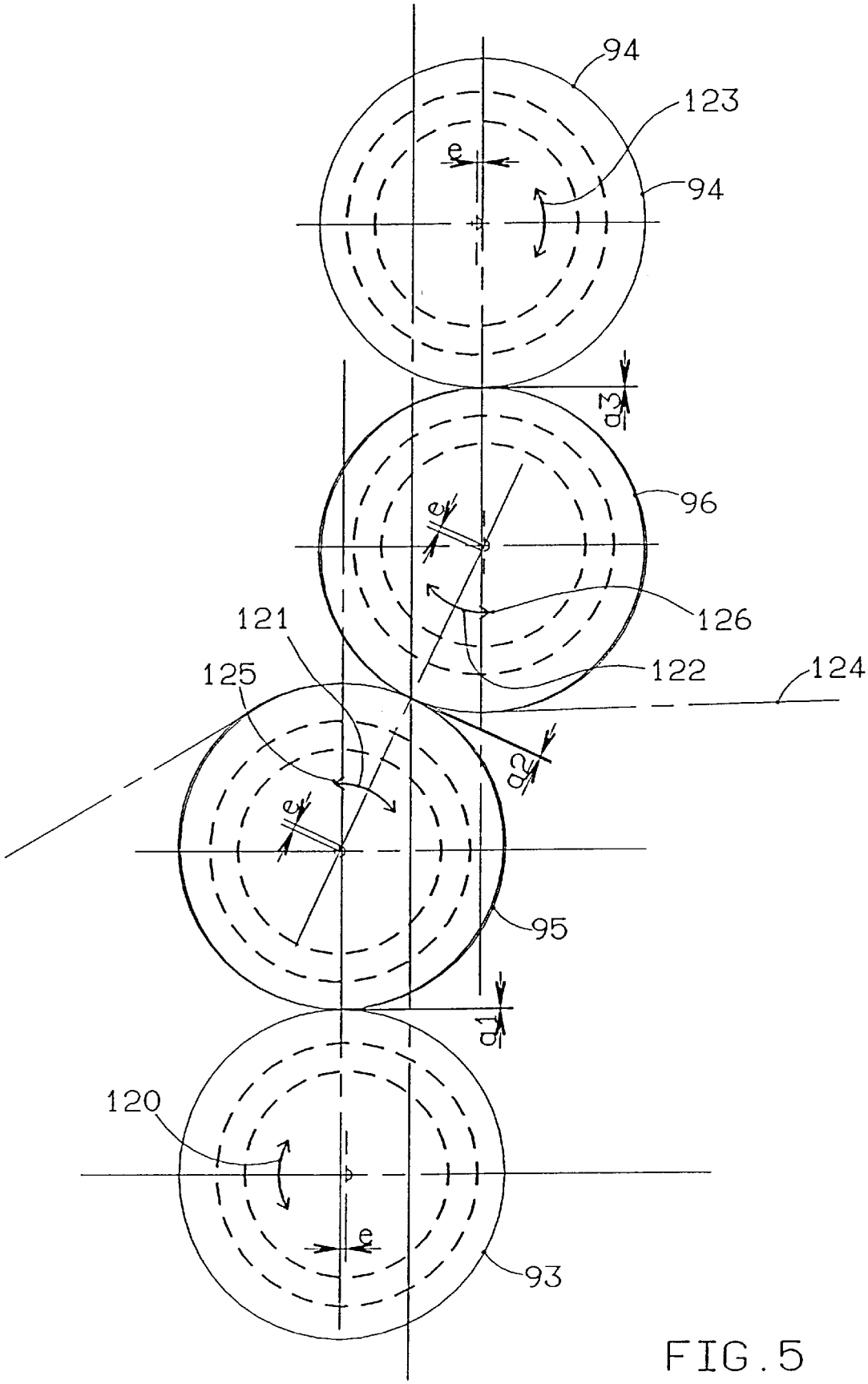
FIG. 5 is a view V in FIG. 3.

FIGS. 3 to 5 show an offset printing group with float-mounted cylinders. The drawings depict a so-called double printing group, in which two printing groups work together on the blanket-to-blanket principle. Form cylinders 93, 94 and blanket cylinders 95, 96 are mounted with the eccentricity e on spindle units 97–100 (FIG. 3). The spindle units 97–100 correspond in design to the spindle units shown in FIG. 2. The spindle units 97–100 are mounted by slide bearings 101, 102 in a side wall 103 and a supporting wall. The supporting wall consists of plates 104–107, which are screwed tightly onto webs or flanges 108–111 in the side wall 103. However, this detail is not the subject matter of the invention and will therefore not be described further.

By means of adjustment units 112–115, the spindle units 97–100 can be turned, as indicated by the double arrows 120–123. For this purpose, levers 116–119 are located on the carrier tubes of the spindle units 97–100. The adjustment units 112–115, which rest directly or indirectly on the side wall 103 (FIG. 4), act upon the levers 116–119.

By pivoting the spindle units 97–100, it is possible, thanks to the eccentricity e, to adjust the distances a1 to a3 of the form and transfer cylinders 93–96 relative to one another (FIG. 5). The form cylinders 93, 94 transfer the printing image via the transfer cylinders 95, 96 onto both sides of a web 124. Doing so requires maintaining an even linear force as well as a defined pressure between the transfer cylinders 95, 96. This pressure is influenced by the thickness of the web 124 that runs between the transfer cylinders 95, 96. The distance a2 between the transfer cylinders 95, 96 must thus be set in accordance with the thickness of the web 124. If a2 changes, this will influence a1 and a3 as well. For this reason, to maintain flawless image transfers from the form cylinders 93, 94 onto the transfer cylinders 95, 96, the distances a1 and a3 of these cylinders relative to one another must also be changed. This is done by activating the adjustment units 112, 114.

Movement out of the printing position is also implemented by means of the adjustment units 113, 115. For this purpose, the spindle units 98, 99 are pivoted into their extreme positions, whereby the distance a2 reaches its maximum. The web 124 is then released by the transfer cylinders 95, 96.

The spindle units 98, 99 that carry the transfer cylinders 95, 96 are axially fixed by axial bearings 127, 128, while the spindle units 97, 100 that carry the form cylinders 93, 94 are movable in the axial direction, as indicated by the double arrows 131, 132 (FIG. 3). By means of this movement, the lateral register can be set. The movement is implemented by means of adjustment units 129, 130, which are supported on the side wall 103 and are connected to the spindle units 97, 100 in articulated fashion.

For the adjustment units 112–115 and 129 and 130, hydraulic or pneumatic working cylinders can be used, for example, as can electric or electric-mechanical cylinders.

As in the embodiment in FIG. 1, rotary encoders 185–188 are attached to the spindle units 97–100 for drive control.

The invention is not limited by the embodiments described above which are presented as examples only but can be modified in various ways within the scope of protection defined by the appended patent claims.

We claim:

1. A driven cylinder of an aggregate of a rotary printing machine with a side wall, in which the cylinder is float mounted, comprising:

a spindle;

a cylinder body arranged on the spindle;

a rotatable carrier tube mounted in the side wall, the spindle being mounted in the carrier tube; and motor means for driving the cylinder body, the motor means being arranged in the carrier tube and connected to the spindle.

2. A driven cylinder as defined in claim 1, wherein the cylinder body is pot-shaped with a bottom, the spindle having a spindle head attached to an outer surface of the cylinder body bottom.

3. A driven cylinder as defined in claim 1, wherein the cylinder body is configured to have a bottom approximately at a mid-point along a longitudinal axis of the cylinder, the spindle having a head connected to the bottom of the cylinder body.

4. A driven cylinder as defined in claim 1, wherein the carrier tube is rotatable mounted in the side wall, the spindle being mounted in the side wall eccentrically relative to a rotational axis of the carrier tube, and further comprising adjustment means for rotating the carrier tube.

5. A driven cylinder as defined in claim 1, wherein the carrier tube is mounted in the side wall in an axially movable manner, and further comprising adjustment means for axially moving the carrier tube.

6. A driven cylinder as defined in claim 1, wherein the cylinder is a form cylinder.

7. A driven cylinder as defined in claim 1, wherein the cylinder is a transfer cylinder.

8. A driven cylinder as defined in claim 1, wherein the cylinder is a web transport roller.

9. A driven cylinder as defined in claim 1, wherein the cylinder is a folding unit cylinder.

* * * * *